US005597100A

United States Patent [19]

Blitz

[11] Patent Number: 5,597,100

[45] Date of Patent: Jan. 28, 1997

[54] GARMENT HANGER HAVING LABEL INDICATOR

[75] Inventor: Leslie S. Blitz, New Hyde Park, N.Y.

[73] Assignee: S.J. Bee Corp., New York, N.Y.

[21] Appl. No.: 601,078

[22] Filed: Feb. 14, 1996

[51] Int. Cl.[6] ..... A47G 25/14; G09F 3/00

[52] U.S. Cl. ..... 223/85; 40/322; 40/493

[58] Field of Search ..... 223/85, 88, 92, 223/95; D6/315; 40/322, 493, 503, 506

[56] References Cited

U.S. PATENT DOCUMENTS

| | | | |
|---|---|---|---|
| 642,576 | 2/1900 | Boydell | 40/493 |
| 4,756,104 | 7/1988 | Bailey | 40/322 |
| 4,997,114 | 3/1991 | Petros | 40/322 |
| 5,238,159 | 8/1993 | Zuckerman | 40/322 |
| 5,441,182 | 8/1995 | Sullivan | 40/322 |

FOREIGN PATENT DOCUMENTS

| | | | |
|---|---|---|---|
| 480128 | 2/1938 | United Kingdom | 40/493 |

*Primary Examiner*—Bibhu Mohanty

*Attorney, Agent, or Firm*—Levisohn, Lerner, Berger & Langsam

[57] ABSTRACT

A hanger for displaying garment-related information has a conventional hanger body and a hanger hook. The hanger body and hook are each provided with a prong extending therefrom and toward one another. A wedge-shaped or cylindrical information indicator is provided with holes in its ends for mating with the prongs of the hanger. The information indicator and hanger combine to form a hanger with a display element for easy viewing of information on the wedge when the hanger is positioned at a variety of different angles with respect to the eyes of the viewer. The information indicator can be used to display sizing information regarding the garment attached to the hanger, eliminating the need to look inside the garment for the garment's label. A child-proof information indicator is provided.

20 Claims, 1 Drawing Sheet

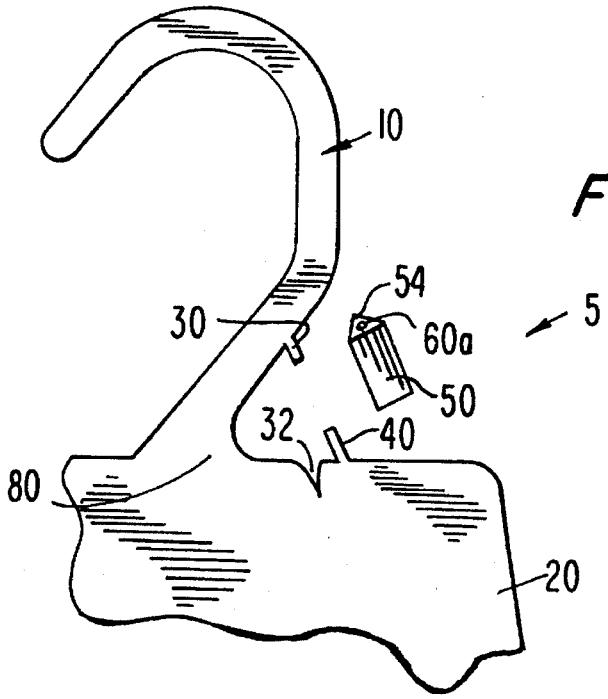
FIG.1
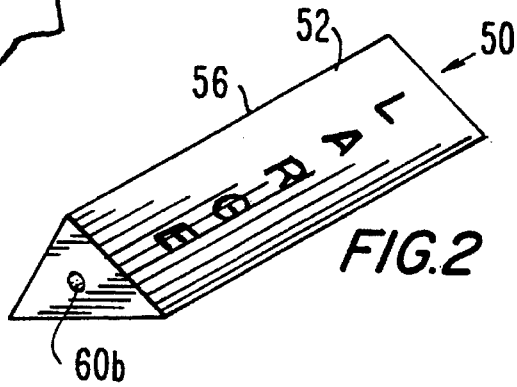
FIG.2
FIG.3b
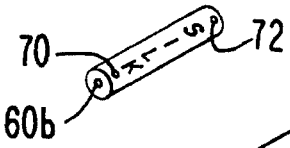
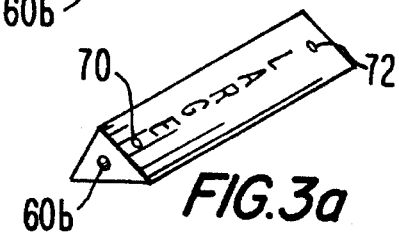
FIG.3a
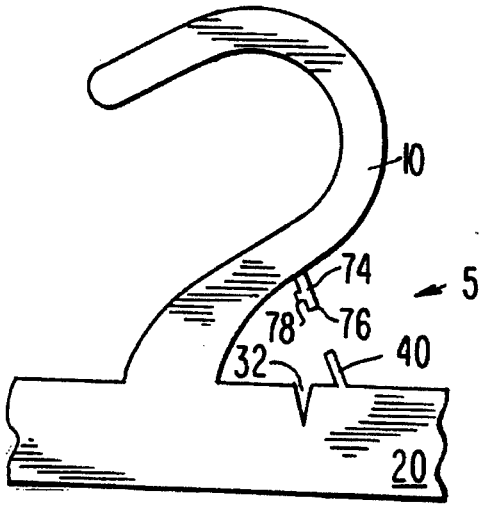
FIG.4

GARMENT HANGER HAVING LABEL INDICATOR

FIELD OF THE INVENTION

The present invention relates to a device for facilitating improved display of a characteristic of a garment attached to a garment hanger, e.g. the size or price. More particularly, the invention relates to a garment hanger having an improved size or price indicator, in the preferred form of a detachable wedge or cylinder, for displaying a specific characteristic of the garment secured thereto. In an alternate embodiment, the garment characteristic indicator is child-proofed so that it cannot be easily removed from the hanger.

BACKGROUND OF THE INVENTION

Garment hangers are well known devices for hanging clothes in a non-folded manner to be hung on a storage rock or in a consumer's closet or wardrobe. The hangers eliminate the need to fold and stack the garments and to thereby introduce wrinkles. As a result, hangers are popular in retail establishments and consumer's homes for holding and displaying garments in an upright position. For retailers, the hanger is a very space-efficient manner of visually displaying a large variety of sizes, colors and styles of garments.

One of the problems with displaying/hanging garments in this manner, however, is that the size of the garment is generally indicated by a visual tag, often secured by thread or plastic or located by sewing inside the garment or on a portion of the hanging garment. The label is not always quickly visible. When the size is indicated on an exterior hang tag, the consumer must manually manipulate the tag to view the size. As a result, when a customer is looking for a garment of a particular style/size, the customer has to manipulate each garment on the hanger to either look at the inside label or fumble with the hang tag. A second problem with common label placement is that it results in consumers touching more garments than necessary to determine if a garment is available in a particular size. This increased "touching" leaves the garment in a more rumpled condition than the consumer/retailer desires for new clothing.

Various devices have been provided in the prior art to address this problem. U.S. Pat. No. 4,115,940 to Phillips provides a garment hanger with a visible size indicator. The garment hanger has a standard hook member for selective engagement with a horizontal clothing rod. The hook is contiguous to the hanger body. A web is provided between the hook member and hanger body. The web has a tab holding or mounting member for securing an indicia carrying tab. The indicia carrying tab is removable and changeable for use with garments of different sizes or prices. A potential problem with the size indicator of the '940 patent is that a child can easily dislodge the tab. The could result in injury to the child, as for example, by swallowing.

U.S. Pat. No. 5,096,101 to Norman et al. discloses a garment hanger including a body having a hook member and a tab holder. The tab holder includes an enlarged region with an information tab including resilient fingers which are captured by the enlarged region to substantially prevent removal of the tab from the tab holder. This is substantially child proof. However, the tab is not easily viewable from a variety of viewing angles especially where many garments are stacked together on a horizontal rod.

Similarly, U.S. Pat. Nos. 5,238,159 and 5,199,608 to Zuckerman provide garment hangers with information tabs secured thereon. A tab holder is integrally formed as part of the hanger, with the tab mounting on an edge of the tab holder, adjacent a ridge formed on the tab holder. The ridge, together with two end members formed on the tab holder on either side of the tab, prevent a consumer from removing the tab prior to purchase. Thus, once the tab is mounted on the tab holder, it cannot be removed without the use of a tool.

A problem with the devices of the prior art, however, is that they are often best suited for garments displayed "head-on", i.e. with the hanger body extending perpendicularly to the line of sight of the user. Thus, when a consumer is looking directly at the front of a garment, he or she can see the garment and the tab easily; however, if the consumer is looking at an angle to a plurality of closely arranged hanging garments, the information on the size indicators are more difficult to read. At the same time, when garments are viewed "head-on" each size indicator blocks the view of the size indicator located behind it.

A further problem with the devices of the prior art is that the solid web member introduces an increase in the amount of plastic needed for each hanger. This results in increased material costs during the manufacturing process. Further, the shape and manner of affixing the prior art tabs to the hanger is time consuming and often difficult. A need exists, therefore, for an indicator which is easy to read from a variety of viewing angles, which is inexpensive to manufacture, can be easily picked up for manual assembly and easy installation and, yet, can also be child-proof.

Accordingly, there is a need for an improved garment hanger having a garment characterization visual indicator, e.g., size indicator, which overcomes the problems present in the prior art. In addition, there is a need for a size indicator which is easily selectively removable and replaceable, while clearly and easily displaying size indicator information from many lines of sight.

SUMMARY AND OBJECTS OF THE INVENTION

An object of this invention is, therefore, to provide an improved garment hanger with a garment characterization indicator which can display the size, price or other characteristic (hereinafter for simplicity purposes, a size indicator) of garments attached thereto.

A further object of this invention is to provide an improved garment hanger in which the size of the garment can be viewed from a variety of different viewing angles, edge-on, head-on or at many angles.

A further object of this invention is to provide an improved garment hanger in which the size of the garment can be viewed regardless of the orientation of the garment hanger.

A further object invention is to provide an improved garment hanger in which the size indicator is, on the other hand, child-proof, and, yet, selectively removable and replaceable by an adult with a simple tool.

A further object of this invention is to provide an improved garment hanger where the size indicator is viewable even though the garment is one of a plurality of closely stacked garments on a horizontal garment rod.

A further object of this invention is to provide a size indicator which can be easily, manually picked-up for ease of installation.

Other objects, advantages and features of this invention will become more apparent hereinafter.

The present objects are accomplished by providing an improved garment hanger having a size indicator in the form of a wedge or cylinder for attachment between a pair of opposed prongs. The three-dimensioned solid, preferably a wedge, has two or more inclined sides and allows the size to be displayed from a variety of viewing angles. The wedge or cylinder shape is easier to manually handle than the flat size tabs of the prior art.

BRIEF DESCRIPTION OF THE DRAWINGS

FIG. 1 is a partial front view of an improved hanger and size indicator wedge (not attached) in accordance with the present invention;

FIG. 2 shows an enlarged perspective view of the size indicator wedge of FIG. 1;

FIG. 3*a* is a perspective view of an alternate embodiment of the size indicator shown in FIG. 2. This embodiment is "child proof" when secured to the hanger shown in FIG. 4;

FIG. 3*b* is a perspective view of an alternate embodiment of the information indicator, also child proof, in the form of a cylinder; and FIG. 4 is a view of the alternate embodiment of the hanger used for a child proof size indicator, similar to that shown in FIG. 1.

DETAILED DESCRIPTION OF THE PREFERRED EMBODIMENTS

As shown in FIG. 1, a cut-away front view of a hanger 5 is provided having a hook or rod-engaging portion 10 and a garment hanger body 20. Hanger 5 is generally made of a plastic material, although other durable, moderately flexible materials are suitable as well. The material used for the hanger should have some flexibility provided between the hook portion 10 and hanger body 20, allowing hook portion 10 and hanger body 20 to be slightly flexed away from each other for a purpose to be described hereinafter. A split 32 is preferably provided along body 20 to ease this flexing. The split 32 is provided in between hook 10 and a lower prong 40 located on the base of hanger body 20. Hanger 5 is suitable for holding shirts, blouses, jackets and so forth. Similarly, hangers may be provided which are suitable for holding pants, skirts, shorts, etc. as is well known in the art. The generally horizontally extending arms of the hanger are not shown but easily understood to be part of the hanger by those of ordinary skill in the art.

The hook portion 10 of hanger 5 is provided with an upper prong 30 and the hanger body 20 is provided with a lower prong 40. Prongs or posts 30 and 40 are generally round, nub-like protuberances extending from the hook portion and body of the hanger; Upper prong 30 is attached to hook portion 10 of the hanger and extends downwardly, while lower prong 40 is attached to hanger body 20 and extends upwardly. The prongs may be of the same size or one may be larger than the other. The prongs can easily be integrally molded with the plastic hanger while using a minimum of additional plastic. The longitudinal axis of prong 30 is aligned with the longitudinal axis of prong 40.

As shown in FIG. 2, a preferred embodiment of a size indicator is provided in the shape of a three-sided, wedge-shaped element 50. Other solid shapes can be used, for example, a cylinder, a parallelpiped, or a five or more-sided solid. The triangular-shaped ends (in the preferred embodiment) of size indicator or wedge 50 are provided with holes 60*a* and 60*b*—hole 60*a* being formed on the top of the wedge (See FIG. 1), and hole 60*b* being a similar corresponding hole on the wedge's other end (See FIG. 2). In an alternate embodiment, a single bore is provided through the information indicator from end to end. The central axis of hole 60*a* and 60*b* are aligned. The wedge can be provided with two or more sides but always with two ends for holes 60*a* and 60*b*. In the preferred embodiment, each side of wedge 50 presents a rectangular face which is easily printed on or can accept pressure sensitive labels having the "size" printed thereon. Two sides 52 and 54 meet at center apex 56. Two other apexes are provided where the other faces intersect. Although it is intended that size information be printed on the wedge or cylinder, other desired information may alternatively, of course, be printed as well, for example, cost, color, fabric, style, manufacturer, etc.

In use, size indicator 50 is attached to hanger 5 by inserting upper prong 30 into hole 60*a* of one end and lower prong 40 into hole 60*b* of the other end of the size indicator. The neck 80 of hanger 5 is bent or flexed slightly to allow hook portion 10 and hanger body 20 to flex slightly away from each other, increasing the distance between prongs 30 and 40. The flexing is enhanced by split 32. The flexing allows the wedge to be inserted between the prongs. Releasing hook portion 10 and hanger body 20 to allow them to resiliently revert to their original positions forces the prongs back toward each other and into holes 60*a* and 60*b* of size indicator or wedge 50. By mating holes 60*a* and 60*b* with prongs 30 and 40, respectively, a tight connection is formed between the hanger and the wedge. Clearly, the length of the wedge must be greater then the distance between the ends of the prongs, lest the wedge easily become dislodged. Just as clearly, the length of the wedge should be slightly less than the distance between the edge of the hook and body, when not subjected to flexing, so that the wedge can be easily placed onto and between the prongs.

One prong may be larger in diameter than the other for proper orientation of the wedge, with the diameters of holes 60*a* and 60*b* corresponding appropriately to the size of their respective prongs such that the size indicator or wedge 50 can only fit onto the prongs with the writing on the size indicator being presented "right side up". In one embodiment, the relative position and sizing of the prongs, the holes and the length of the wedge are such that the size indicator is tightly held in place and cannot rotate about defined by the prongs.

As shown in FIG. 2, wedge 50 is a three-sided, wedge-shaped element for displaying the size of garments affixed to the hanger. Size information for an attached garment can be printed on one, two, or all three of the sides of the wedge, for easy reading when the wedge is affixed to the hanger. Wedge-shaped size indicator element 50 may be made of any suitable material. Although plastic is contemplated, metal, or other common materials may be utilized as well.

When attached to the hanger, wedge 50 can be presented in any one of numerous possible visual orientations. Size indicator or wedge 50 may be affixed with the apex 56 of the wedge approximately in the central plane defined by the hanger 5. In this position, a consumer can see the markings on the wedge from a perspective view of the hanger, or from a head or edge on view, as well. The wedge can be angled so that the apex is not aligned with the body and arms of the hanger. The information is easily viewable from perspective angles, even if the viewer is viewing a plurality of garments stacked together on the horizontal garment rod. Other angles of fixation of the wedge between the prongs are, of course, possible, and are contemplated within the scope of the invention.

FIGS. 3 and 4 relate to an alternate embodiment of the invention. This version is substantially child-proof in that a small child cannot remove the wedge from the hanger. In this embodiment, one or more of the holes 60*a* or 60*b* are associated with cross-directed holes 70 and 72. These holes 70 and 72 extend from one face 52 of the wedge to holes 60*b* and 60*a*, respectively. FIG. 4 shows the modified hanger for use with the child-proof wedge of FIG. 3. Only one child-proof prong 74 is illustrated, as a replacement for upper prong 30 of the embodiment of FIG. 1. Of course, lower prong 40 can be replaced with a child-proof prong, substantially the same as prong 74. Prong 74 has a first segment 76 which is quite like prong 30. Extending perpendicularly across the axis of segment 76 is cross-piece 78. The dimension from cross piece 78 to the back first segment 76 is slightly greater than the internal diameter of hole 60*a* of the wedge. The resiliency of prong 74, however, allows for it to be pushed inside hole 60*a* of the wedge and, when cross-piece 78 aligns with cross-hole 72, the cross-piece will flex back and snap to its perpendicular orientation with cross-piece 78 extending into hole 72. In this manner, it will be very difficult to remove the wedge from the hanger. To remove the wedge, a small tool, e.g., a pencil point or the tip of a paper clip can be pushed inside of hole 72 while simultaneously pulling the wedge off of the hanger. It should be appreciated that a child-proof size indicator is thus provided. Selective removal by adults is a feature, as well.

Consequently, the present invention makes it advantageous and easy to view the size information on a garment from a variety of different positions and angles. Since the preferred embodiment is a wedge element which is three-sided with the three sides forming a complete 360° angle or circle, its positioning in the prongs of the hanger allows size information to be easily viewed irrespective of the positioning of the garment with respect to the consumer. The retailer may, if desired, remove the wedge at the time of the purchase for inventory and purchase control. The design of the prongs and wedge makes the present invention inexpensive and easy to manufacture.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

I claim:

1. A hanger for displaying information, comprising:

a hanger body, said hanger body having a first prong extending therefrom;

a hanger hook, said hanger hook having a second prong extending therefrom, said second prong extending toward said first prong;

an information indicator having a first hole on a first end, and a second hole on an opposed second end, said first hole being of a size to receive said first prong, and said second hole being of a size to receive said second prong, said information indicator being of a length such that it can be attached to said hanger by mating said first hole with said first prong and said second hole with said second prong.

2. A hanger as claimed in claim 1, wherein at least two-pieces of garment-related information are provided on said information indicator.

3. A hanger as claimed in claim 1, wherein said information indicator is a cylinder.

4. A hanger as claimed in claim 1, wherein said information indicator is a wedge.

5. A hanger as claimed in claim 1, wherein said information indicator is three-dimensional and multi-sided.

6. A hanger as claimed in claim 2, wherein the information of said information indicator describes at least two different characteristics of a garment for display by said hanger.

7. A hanger as claimed in claim 4, wherein said hanger body defines a first plane and said wedge is attached to said hanger such that a plane formed by one side of said wedge is perpendicular to said first plane.

8. A hanger as claimed in claim 4, wherein one side of said wedge, perpendicular to said hanger body faces away from a viewer when said hanger is viewed from its side.

9. A hanger as claimed in claim 1, wherein said hanger body and said hanger hook are virtually resilient to allow said hanger body and said hanger hook to be flexed away from each other to allow said information indicator to be selectively secured to said hanger.

10. A hanger as claimed in claim 1, wherein said first prong is substantially aligned with said second prong.

11. A hanger as claimed in claim 1, wherein said prongs are of different sizes and said holes are of corresponding different sizes to ensure proper orientation of said information indicator on said hanger.

12. A hanger as claimed claim 1, further comprising a split on said hanger body to facilitate relative flexing between said hanger hook and said hanger body.

13. A hanger as claimed in claim 1, wherein said first hole and said second hole are formed from a single bore passing through said information indicator.

14. A hanger as claimed in claim 4, wherein said wedge is three-sided.

15. A hanger as claimed in claim 1, wherein said information indicator is of a length such that mating of said holes with said prongs prevents said information indicator from rotation.

16. A hanger as claimed in claim 1, further comprising child-proof means to prevent unintentional removal of said information indicator from said hanger.

17. A hanger as claimed in claim 16, wherein said child-proof means comprises said information indicator being provided with at least one cross hole to at least one of said first hole and said second hole, and either said first or second prong provided with a cross segment which matingly engages with said cross hole.

18. A hanger as claimed in claim 17, wherein both said first and second holes of said information indicator are provided with cross holes and both said upper prong and said lower prong are provided with said cross segments.

19. A hanger as claim in claim 17, wherein said cross segment is resiliently compressible with respect to said prong from which said cross segment extends.

20. A hanger as claimed in claim 17, wherein the dimension defined by said prong and said cross segment, when not compressed, is slightly greater than the diameter of said cross hole within which said prong, with said cross segment, extends.

* * * * *